United States Patent [19]

King

[11] Patent Number: 5,044,533

[45] Date of Patent: Sep. 3, 1991

[54] CLAMP FOR BANDLESS REFRACTORY AND METHOD

[75] Inventor: Patrick D. King, Bantoul, Ill.

[73] Assignee: Flo-Con Systems, Inc., Champaign, Ill.

[21] Appl. No.: 591,067

[22] Filed: Oct. 1, 1990

[51] Int. Cl.[5] ..... B22D 41/50

[52] U.S. Cl. ..... 222/606; 222/591; 222/590

[58] Field of Search ..... 222/591, 590, 597, 602, 222/600, 606, 607

[56] References Cited

U.S. PATENT DOCUMENTS

| | | | |
|---|---|---|---|
| 3,685,705 | 8/1972 | Cessna | 222/600 |
| 4,660,749 | 4/1987 | Yokoi et al. | 222/600 |
| 4,887,748 | 12/1989 | Hicks | 222/591 |

*Primary Examiner*—S. Kastler

*Attorney, Agent, or Firm*—Jack E. Dominik

[57] ABSTRACT

A sliding gate valve assembly which has a stationary refractory plate mounted to a mounting plate and secured there by the force pressed against it exerted by another refractory is disclosed. A clamp ring is provided which has extending ears, each of which is bored to ride on a clamp spring assembly. Yieldable means, preferably a coil spring, surrounds the shank of the clamp spring assembly guide shank and engages the underside of the ear and rides in the main frame. When the main frame is closed, pressure is urged on the spring which, in turn, transmits the force to the clamp, the tapered inner edge of which engages the tapered outer edge of the stationary plate. The method of the present invention depends upon utilizing the clamping force of a valve assembly having a main frame and in which yieldable means are provided between the main frame and the mounting plate to urge a continuous clamp ring into engagement with the bandless stationary plate having tapered sidewalls.

8 Claims, 3 Drawing Sheets

10
15
35
36
48
39
40
38
41
26
30
46
25
50

CLAMP FOR BANDLESS REFRACTORY AND METHOD

FIELD OF THE INVENTION

The present invention relates to valves of the type used primarily in the teeming of steel. Such valves are exemplified by U.S. Pat. Nos. 4,582,232 and 4,573,616.

SUMMARY OF THE PRIOR ART

The prior art is also exemplified by U.S. Pat. No. 4,063,668. The refractory inserts in the valve shown in that patent, however, are encased in a metal jacket. An improved-type refractory is shown in U.S. Pat. Nos. 4,582,232 and 4,573,616 where there is no metal encasement of the refractory, and the refractory side edges are tapered in such a fashion that they receive clamping members which exert a force component both centrally and downwardly to simultaneously retain the refractory against expansion and cracking due to thermal shock, and also provide a downward component (in some instances upward where the top plate is clamped) to hold the refractory to the valve. While this has provided an improvement, the means for clamping the refractory to the mounting plate in the situation of the upstream of stationary plate has required one or more elements which have to be bolted to a mounting plate. This takes time, and the bolts are subject to the highly corrosive environment of the teeming of steel. What is desirable is to develop a clamp which is virtually automatic in nature, and wherein the force of the springs and the clamping to the main frame is employed to urge an external clamping action against the periphery of the refractory.

SUMMARY OF THE INVENTION

The present invention is directed to a sliding gate valve assembly which has a stationary refractory plate mounted to a mounting plate and secured there by the force pressed against it exerted by another refractory. A clamp ring is provided which has extending ears, each of which is formed to ride on a clamp spring assembly. Yieldable means, preferably a coil spring, surrounds the shank of the clamp spring assembly guide shank and engages the underside of the ear and rides in the main frame. When the main frame is closed, pressure is urged on the spring which, in turn, transmits the force to the clamp, the tapered inner edge of which engages the tapered outer edge of the stationary plate. The method of the present invention depends upon utilizing the clamping force of a valve assembly having a main frame and in which yieldable means are provided between the main frame and the mounting plate to urge a continuous clamp ring into engagement with the bandless stationary plate having tapered sidewalls.

It is a principal object of the present invention to minimize the time of mounting a bandless refractory having tapered sidewalls into position as the stationary plate of a valve assembly.

A related object of the present invention is to eliminate the necessity for bolting one or more elements to a mounting plate to thereby secure a stationary bandless refractory in position.

Yet another object of the present invention is to provide the above advantages in a construction which is simple, inexpensive, and repeatedly durable and effective in usage.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 2:
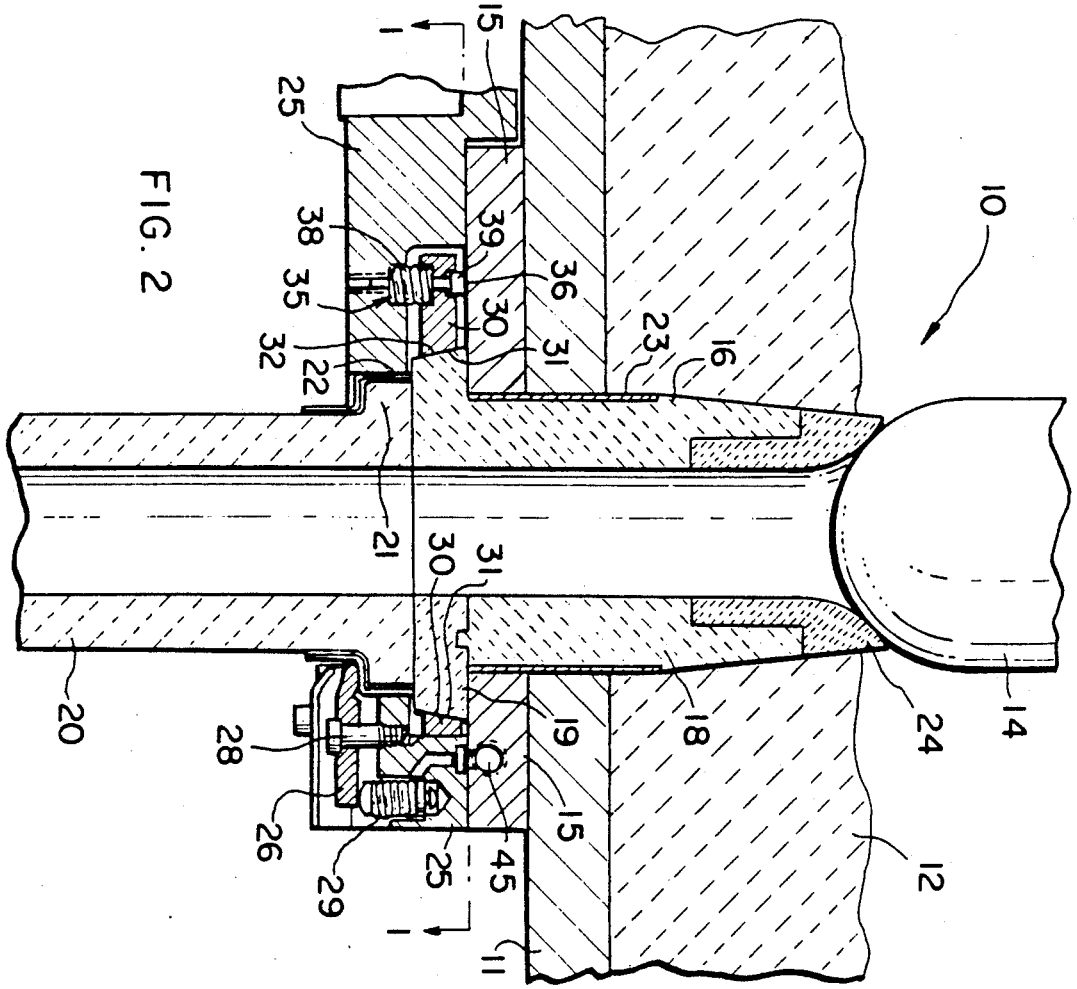
FIG. 2 is a skewed sectional drawing of the valve assembly of FIG. 1 taken along section line 2—2 and showing on the left side a unitary nozzle plate, and on the right side of center, an exemplary two-piece nozzle and interlocking plate.

Turning now to FIG. 2, it will be seen that the exemplary valve assembly 10 is secured to the exterior portion of a vessel. The nozzle 18 penetrates the vessel wall 11 which is normally a steel shell, and the vessel lining 12 which is normally a refractory brick. In the present instance a stopper rod 14 engages the upper portion of the nozzle 18 to permit or stop the flow of steel from the interior portion of the vessel to the tube 20. The valve assembly 10 is secured to the vessel 11 by means of a mounting plate 15, the same securing the tube 20 to the nozzle plate 16. The nozzle plate 16 shown to the left-hand portion of the center line is unitary including both the nozzle portion and plate portion. Shown diagrammatically at the right-hand side of FIG. 2 is a two-piece nozzle 18, with a lower plate 19 interlocked and secured to the nozzle 18. In the application with a stopper rod, there is a risk of aspiration at any joint, and accordingly the unitary nozzle plate construction 16 is most desirable. On the other hand there are applications where different refractory materials may be employed, and then the individual nozzle 18 cooperating with the plate 19 may prove more desirable. Hereinafter and in the claims the term nozzle/plate collectively refers to both embodiments.

The tube 20 has a tube collar 21 at its upstream portion, and is surrounded by a tube collar band 22 normally of a metal material. The purpose of the tube collar band is to receive the rocker arms 26 and permit the tube to be exchanged or shifted in and out of teeming relationship with the nozzle/plate 16. A stopper rod seat 24 is provided at the upper portion of the nozzle/-plate 16 or the nozzle 18. It is curvilinear and seats with the curvilinear bullet nose of the stopper rod 14. The main frame 25 is shown in both FIGS. 1 and 2 and secures the rockers 26 which are mounted to rocker pivots 28 and rocker spring 29 so that the central end of the rocker 26 engages the downstream portion of the tube collar band 22.

Figure 1:
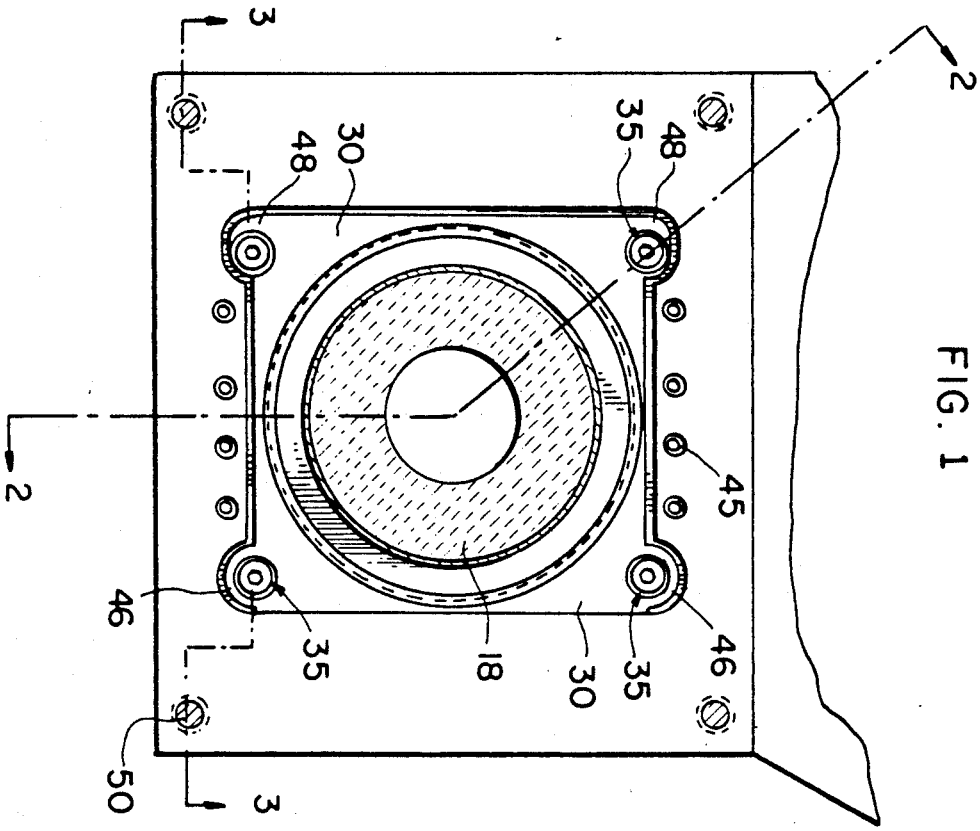
FIG. 1 is a plan view through a central portion of the valve assembly taken essentially along Section line 1—1 of FIG. 2.
Figures 3, 4, 5:
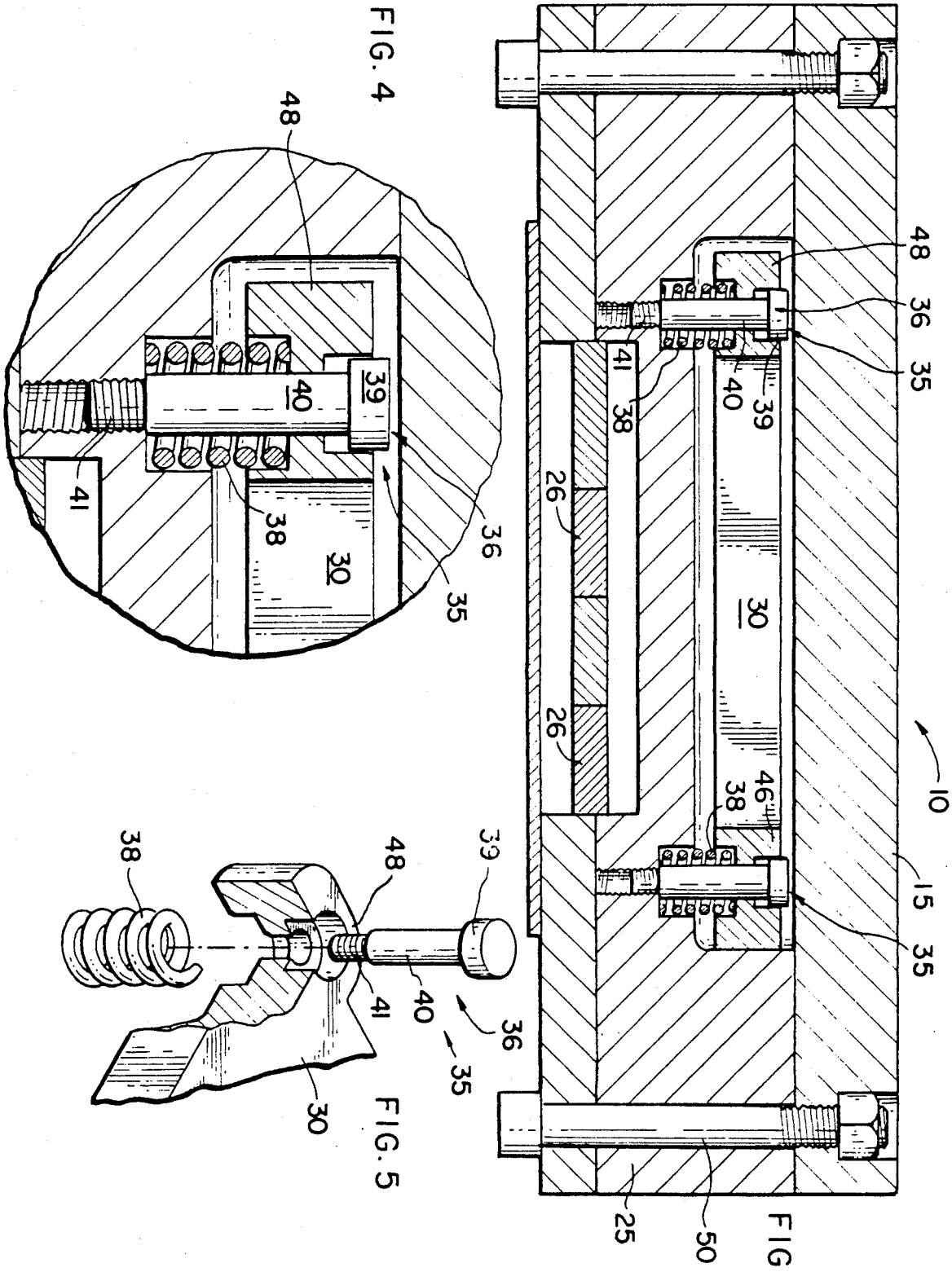
FIG. 3 is sectional view taken along section line 3—3 of FIG. 1 illustrating in particular the spring assemblies utilized in engaging the clamping ring and the bolt assembly utilized in securing the main frame to the mounting plate.
FIG. 4 is an enlarged view of the spring assemblies shown in FIGS. 2 and 3.
FIG. 5 is a fragmentary, exploded three-dimensional view of the spring assembly of FIG. 4.

In accordance with the invention, the clamp ring 30 as shown in FIGS. 1, 2 and 3 is essentially rectangular and provided centrally with a clamp ring taper 31 which matingly engages the plate taper 32 of the plate 19 or the lower portion of the plate nozzle 16.

Particularly as shown in FIGS. 2, 3 and 4, the clamp spring assembly 35 includes a clamp guide 36 and a clamp spring 38, the clamp spring being secured beneath the guide head 39 and in coaxial relationship to the clamp guide shank 40 above the mounting threads 41. This relationship is shown in enlarged scale in FIG. 4, and in exploded relationship in FIG. 5.

Finally, turning now to FIG. 1, it will be seen that there is a rocker spring cooling manifold 45 with a plurality of orifices mounted to cool the rocker springs in operation. The clamp ring 30 is provided with clamping ears 46 at one side, and the clamp key 48 at the opposite corners is of a different size to prevent reversal of the clamp ring 30. Finally, the mounting bolts 50 are employed, particularly as shown in FIG. 3, to secure the main frame to the mounting plate.

The Method

Figure 6:
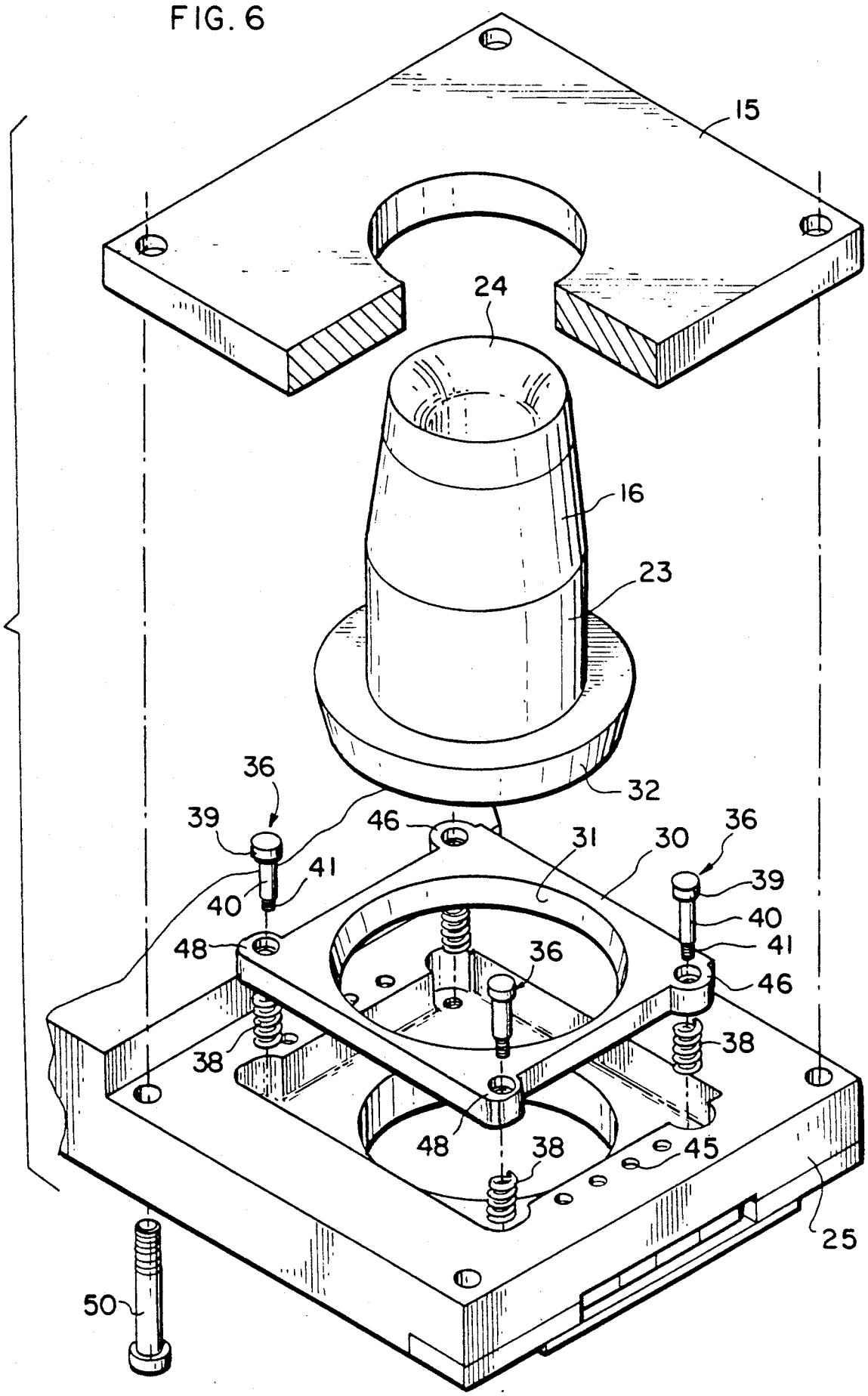
FIG. 6 is an exploded three-dimensional view of the components of FIGS. 1 and 2.

The method of operating the subject valve assembly 10 includes mounting such a valve assembly 10 onto a vessel wall 11 and positioning a mounting plate 15 onto the vessel wall 11 and inserting a nozzle/plate 16 or nozzle 18 and plate 19 into the vessel. The relationship of the elements and the sequence of assembly is illustrated in FIG. 6. Provision must be made for a main frame 25 having rockers 26 and including a clamp ring 30 having a central clamp ring taper 31 against the plate taper 32. The clamp spring assembly 35 is also provided to bridge the gap between the clamp ring 30 and the main frame 25. Thereafter, the steps of the method involve firstly placing the clamping ring 30 in surrounding relationship to the plate 16, 19 by the opposed tapered sidewalls 31, 32. Thereafter, the clamping ring 30 is loaded in engagement with the tapered sidewalls 32 of the plate 16, 19 by means of clampingly engaging the main frame 25 to the mounting plate 15 thereby applying a compressive pre-stress in plate 16, 19. The final step in the method contemplates proportioning the spacial relationship between the mounting plate 15, main frame 25, clamping ring 30, and yieldable spring assembly 35 to insure that the mounting force of the frame 25 is shared between the preloading of the clamp ring 30 to the plate 16, 18 and the subsequent clamping action by the main frame 25 against the clamping ring 30 as the main frame 25 is secured to the mounting plate 15.

Although particular embodiments of the invention have been shown and described in full here, there is no such limitation of embodiments. On the contrary, the intention is to cover all modifications, alternatives, embodiments, usages and equivalents as fall within the spirit and scope of the present invention, specification and appended claims.

What is claimed is:

1. A valve assembly comprising, in combination, an unencased plate assembly and a depending tube assembly for insertion into a vessel in which the side walls of the nozzle plate are continuous and continuously taper outwardly from the downstream face of the plate toward the vessel, a mounting plate for securing the valve assembly to a vessel, a main frame for yieldably urging a depending tube assembly having an upstream flat face in fact to face relationship with the outer face of the unencased plate, a clamp ring for insertion interiorly of the main frame having tapered sidewalls for a meeting engagement with the unencased plate sidewalls, spring assemblies for seating in the main frame and bearing against the clamp ring, means for clampingly securing the main frame to the mounting plate, means on the clamp ring for securing the same to the main frame, all of said elements namely unencased plate assembly, mounting plate, depending tube assembly, main frame, clamp ring, spring assembly, clamping means and securing means, being proportioned and oriented to permit the means for securing the clamp ring to the main frame to preload the spring assembly against the clamp ring, and when subsequently securing the main frame to the mounting plate, further applying pressure to the spring assembly, whereby upon the closing of the main frame to the mounting plate the clamp ring has a preselected substantial central and clamping force engaging the periphery of the continuous sidewall of the plate.

2. In the valve assembly of claim 1 above, said tube assembly having a tube collar at its upstream portion, said main frame having a plurality of spring mounted pivotal members for securing the upstream portion of the tube in teeming relationship with the nozzle.

3. In the valve assembly of claim 1 above, means for engaging said tube assembly with a replacement tube and moving a tube to be exchanged along the rocker arm support assembly by means of a new tube to be placed in service.

4. In the valve assembly of claim 1 above, said spring assembly for engaging the clamp ring having a clamping guide, said guide having an enlarged head, said guide having a guide shank terminating at its lower end with mounting threads, and a spring for coaxially engaging the clamping guide beneath the guide head and the opposite end of the spring engaging a seat interiorly of the main frame.

5. A method for securing a valve assembly having a frame and a yieldable spring assembly in which an unencased refractory plate having tapered sidewalls is engaged in surrounding fashion by a clamp ring having mating tapering sidewalls and in which a mounting plate receives a main frame which is clampingly secured thereto, comprising the steps of first placing the clamping ring in surrounding relationship to the plate having tapered sidewalls and preloading the same to the spring assembly, loading the clamping ring in engagement with the tapered sidewalls of the plate by means of clampingly engaging the main frame to the mounting plate, and proportioning the special relationship between the mounting plate, main frame, clamping ring, and yieldable spring assembly to ensure that the mounting force of the frame is shared between the loading of the clamp ring to the plate and the loading to effect sealing of the face to face relationship of the plates in the valve assembly.

6. A clamp ring assembly for use in a valve for teeming metal from a vessel in which the valve includes a mounting plate for securing the same to the vessel, a frame which is removably secured to the mounting plate by clamping means, a stationary refractory adjacent a teeming orifice in a nozzle in the vessel, said refractory having tapered end walls tapering outwardly in an upstream direction toward the mounting plate, said clamp ring assembly comprising, in combination, a clamp ring proportioned to surround the stationary refractory having tapered walls, said clamp ring having spring engaging means on its periphery, a spring assembly mounted in the frame and secured to the clamp ring spring engaging means, the foregoing all proportioned and oriented to permit preloading of the clamp ring prior to closing the frame onto the mounting plate by means of the mounting means, whereby a first preload is applied to the clamp ring and thereafter a secondary load applied by the frame clamping means to the end that the load on the clamping ring is shared between the spring assembly and the means for clamping the frame to the mounting plate.

7. In the valve assembly of claim 6 above, said spring assembly for engaging the clamp ring having a clamping guide, said guide having an enlarged head, said guide having a guide shank terminating at its lower end with mounting threads, and a spring for coaxially engaging the clamping guide beneath the guide head and the opposite end of the spring engaging a seat interiorly of the main frame.

8. A method of securing a valve assembly in which a stationary plate having tapered sidewalls is engaged in surrounding fashion by a clamp ring having mating tapering sidewalls, a tube holder having a plate portion and in which a mounting plate receives a main frame which is clampingly secured thereto and in which a yieldable assembly is provided interiorly in the frame and coupled relationship to the clamp ring, comprising the steps of:

placing the clamping ring in surrounding relationship to the plate having tapered sidewalls, loading the clamping ring in engagement with the tapered sidewalls of the plate by means of clampingly engaging the main frame to the mounting plate, and proportioning the spacial relationship between the mounting plate, main frame, clamping ring, and yieldable spring assembly to ensure that the mounting force of the frame is shared between the loading of the clamp ring to the plate having tapered sidewalls and the loading to effect sealing of the face to face relationship of the plates of the tube holder and stationary plate in the valve assembly.

* * * * *

UNITED STATES PATENT OFFICE
CERTIFICATE OF CORRECTION

PATENT NO. : 5,044,533

DATED : September 3, 1991

INVENTOR(S) : Patrick D. King

It is certified that error appears in the above-identified patent and that said Letters Patent is hereby corrected as shown below:

Col. 4

Claim 5, line 59, "special" should read -- spacial --.

Signed and Sealed this

Twenty-ninth Day of June, 1993

Michael K. Kirk

*Attest:*

MICHAEL K. KIRK

*Attesting Officer*

*Acting Commissioner of Patents and Trademarks*